US006128983A

United States Patent [19]

Arnn

[11] Patent Number: 6,128,983

[45] Date of Patent: Oct. 10, 2000

[54] DRIVE TOOL FOR FASTENERS

[76] Inventor: Edward T. Arnn, 3 Little Sorrel La., Lexington, Va. 24450

[21] Appl. No.: 09/225,830

[22] Filed: Jan. 6, 1999

[51] Int. Cl.[7] ..... B25B 23/00

[52] U.S. Cl. ..... 81/460; 81/436

[58] Field of Search ..... 81/436, 460, 461, 81/451

[56] References Cited

U.S. PATENT DOCUMENTS

| | | | |
|---|---|---|---|
| 2,268,515 | 12/1941 | Olson | 81/460 |
| 2,800,936 | 7/1957 | West | 81/460 |
| 3,207,196 | 9/1965 | Stillwagon, Jr. | 81/460 |
| 3,695,321 | 10/1972 | Garehime, Jr. | 81/461 |
| 3,891,017 | 6/1975 | Iskra | 81/436 |
| 3,913,647 | 10/1975 | Arnn . | |
| 3,923,088 | 12/1975 | Arnn . | |
| 3,985,170 | 10/1976 | Iskra | 81/460 |
| 4,105,056 | 8/1978 | Arnn . | |
| 4,325,153 | 4/1982 | Finnegan | 81/461 |
| 4,339,971 | 7/1982 | Zatorre | 81/460 |
| 4,590,825 | 5/1986 | Vaughn . | |
| 5,353,667 | 10/1994 | Wilner | 81/461 |
| 5,528,966 | 6/1996 | Coppejans . | |
| 5,660,091 | 8/1997 | Stone et al. | 81/460 |

*Primary Examiner*—David A. Scherbel
*Assistant Examiner*—Joni B. Danganan
*Attorney, Agent, or Firm*—Larson & Taylor, PLC

[57] ABSTRACT

A drive tool for use in driving a fastener having a combination head having slots to accommodate either a flat-blade screwdriver or a Phillips-type screwdriver, the drive tool having both a flat-blade and a Phillips-type blade, and foot portions positioned on each of said flat-blade and said Phillips-type blade for engaging the slots in the combination head. Additionally, a centering tip is provided that fits into the slots of the combination head and allows the drive tool to be guided into proper position by the slots.

5 Claims, 3 Drawing Sheets

DRIVE TOOL FOR FASTENERS

BACKGROUND OF THE INVENTION

1. Field of the Invention

The present invention relates to a drive tool for fasteners and more particularly to a screwdriver specially adapted to interact with a combo or uni-screw which has two slots that cross at their centers to accommodate either a type flat-blade screwdriver, or a phillips-type blade screwdriver.

2. Prior Art

When turning any screw such as a combo screw, sometimes the situation dictates the use of only one hand, as in the case when the screw is difficult to see and/or access. This often requires that the screwdriver blade be repositioned onto the head of the screw with every partial turn. Having to repeatedly mate the screwdriver blade with the screw can make a tough job even tougher. To add to the frustration, both standard flat-blade and standard phillips-blade screwdrivers have a tendency to slip out from the properly mated turning position during turning.

Accordingly, the present invention was developed to provide a screwdriver blade that enables easier insertion of a screwdriver blade into a combo screw while providing more secure retention of the screw head during torquing.

There are many screwdriver blades in existence. U.S. Pat. No. 4,590,825 to Vaughn discloses a specially designed screwdriver blade that mates with a corresponding screw. The screwdriver blade has an bowtie-shaped arcuately convex blade that interacts with a concave bowtie-shaped slot in the head of the screw. A centrally disposed conical tip formed on the end of the blade mates with a conical recess in the screw. This type of screwdriver can not be used with standard combo screws of the type described above.

U.S. Pat. No. 5,528,966 to Coppejans discloses a screwdriver blade designed to interact with combo screws.

The screwdriver blade disclosed in Coppejans has a phillips-type screwdriver tip that extends beyond the flat-blade tip portion to provide a blunted cross-shaped tip on the end of the combo screwdriver blade.

U.S. Pat. No. 4,105,056 to Arnn, the inventor of the present invention, discloses a flat screwdriver blade having a foot portion, disposed at the screwdriver tip, that is used for reducing the usual slippage associated with flathead screwdrivers. Typically, screwdriver blades have converging flat sides that cause the flathead screwdriver to slip out of proper torquing position, but the foot portion of the blade disclosed in the Arnn '056 patent bites into the screw to prevent this slippage. The disclosure of the Arnn '056 patent is herein incorporated by reference.

Another patent to the inventor of the present invention, U.S. Pat. No. 3,913,647, discloses a phillips-type screwdriver blade having foot portions on each side of the four phillips-type blades. These foot portions interface with the crossed slots of the phillips-type screw to reduce the likelihood of slippage that results during torquing. The phillips-type blade of the Arnn '647 screwdriver is similar to that of a standard phillips-type blade screwdriver in that the tip has a cross shape. The disclosure of the Arnn '647 patent is herein incorporated by reference.

SUMMARY OF THE INVENTION

Thus, it is a purpose of the present invention to overcome the disadvantages of the prior art and thereby provide a screwdriver for use with combo screws or uni-screws that have channels that mate with either flat-blade or phillips-type screwdrivers. In a preferred embodiment, the screwdriver blade of the present invention has a centering tip that takes advantage of a combo screw's center depression to facilitate centering. Advantageously, the blade also has a nipple on the centering tip that is small enough to engage the channels. The engagement between the nipple and the channels of the screw enable a user to use the channels as a guide to position the centering tip in the screw's center depression. Once the centering tip is in the screw's center, the screwdriver can be rotated into proper position for torquing the combo screw. The proper position for torquing results when the flat blade of the screwdriver mates with a flat channel of the combo screw.

When the screwdriver blade is in this position, foot portions located on each blade bite into the corresponding channel walls to prevent the screwdriver from slipping or jumping out of proper position when being torqued.

These and other objects of the present invention will become apparent from the detailed description to follow.

BRIEF DESCRIPTION OF THE DRAWINGS

There follows a detailed description of the preferred embodiments of the present invention which are to be taken together with the accompanying drawings, wherein.

DETAILED DESCRIPTION OF THE DRAWINGS

Other features and advantages of the invention will be set forth in, or apparent from, the detailed description of the preferred embodiments of the invention which is found hereinbelow.

Referring now to the figures, like elements are represented by like numerals throughout the several views.

Figure 1:
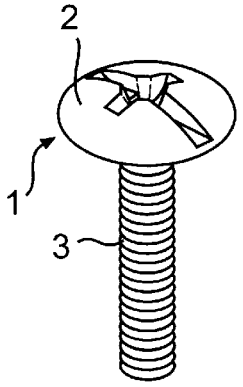
FIG. 1 PRIOR ART
FIG. 1 is a perspective view of a prior art combo screw.
Figure 2:
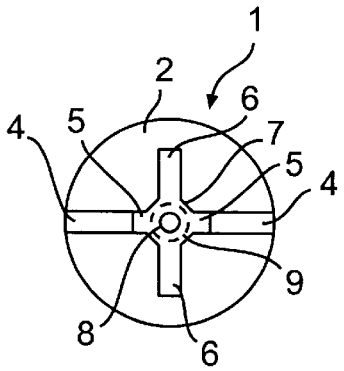
FIG. 2 PRIOR ART
FIG. 2 is a top plan view of the combo screw of FIG. 1.

FIG. 1 depicts a typical prior art combo screw or uni-screw 1 that has a screw head 2 and shaft 3. FIG. 2 illustrates a top plan view of the prior art screw shown in FIG. 1, so as to more clearly depict the pair of perpendicular slots or channels 4 and 6. Channel 4 is made to cooperatively fit with a flat screwdriver blade. Channel 4 also has concave depressions 5 that are deeper than channel 4 so that concave depressions 5 can be used in conjunction with concave channel 6 to enable a phillips-type blade screwdriver to effectuate turning of screw 1.

Figure 3:
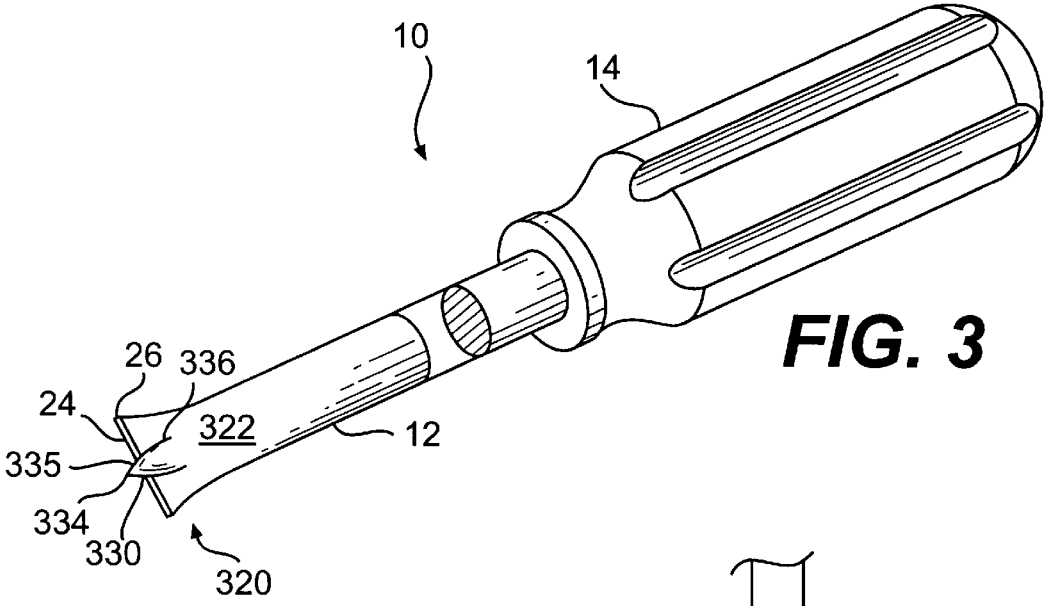
FIG. 3 is a perspective view of a first embodiment of the invention.
Figure 3A:
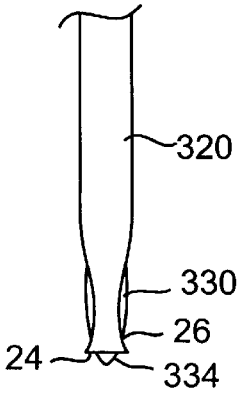
FIG. 3*a* is a side elevational view of the blade in the embodiment of the invention shown in FIG. 3.

The present invention takes advantage of the aforementioned qualities of the prior art screw 1 depicted in FIGS. 1 and 2. A first embodiment of the invention is illustrated in FIGS. 3 and 3*a* where a screwdriver 10 is shown as having a shaft 12 connected to a handle 14. Disposed on an end of shaft 12 distally from handle 14 is a screwdriver blade 320. Screwdriver blade 320 has a pair of substantially flat opposing sides 322, a substantially flat end 24, a foot 26, and a centering tip 330.

Substantially flat end 24 is a face that is used to cooperate with channel 4, and is similar to the flat end of a flat-blade screwdriver. However, immediately adjacent to flat end 24 is foot 26 that is formed on each side into the substantially flat opposing sides 322. Opposing sides 322 converge from shaft 12 towards flat end 24, but sharply diverge immediately adjacent flat end 24 to form the wedge-like shape of foot 26 used to bite into channel 4 when the screwdriver 10 turns combo screw 1. Foot 26 is shown as being of the shape disclosed in U.S. Pat. No. 3,923,088, to Arnn, the inventor of the present invention (the disclosure of which is herein incorporated by reference) but can also be of other foot shapes, such as that disclosed in U.S. Pat. No. 4,105,056, also to Arnn (i.e., pentagon-shaped). Centering tip 330 is centrally located with the longitudinal axis of shaft 12 so that the longitudinal axis is aligned with the central axis of the centering tip 330.

Centering tip 330 is shown in FIG. 3 as having a tip point 334 and a tip base 336. The shape of the centering tip 330 can vary widely as will be discussed below in conjunction with other embodiments. A particularly advantageous feature of the invention is that the tip point 334 is sized sufficiently small enough, as compared to the channels 4 and 6 of screw 1, to fit substantially within channel 4 or 6. This enables the screwdriver blade 320 to be used to easily find the proper position of insertion for mating screwdriver blade 320 with the appropriate channel use for torquing. Specifically, centering tip 330 cooperates with channels 4 or 6, and uses these channels as a guide for tip point 334 to follow in order to be aligned above a bottom center 8 of screw head 2.

This locating feature of the present invention, resulting from the size and shape of tip point 334, is particularly useful when the location and orientation of screw 1 is difficult to see or access, or when screwdriver blade 320 must be repetitiously inserted into proper turning position as is often the case when only one hand can be used for manual turning. In these situations, the user frequently fumbles around trying to properly mate the screwdriver blade with the screw.

Phillips-type screwdrivers have a tip that assists in centering the screwdriver blade relative to the screw, but only when the tip is relatively close to the depressed region 9 shown enclosed by dashed lines in FIG. 2. In other words, when the tip of a phillips-type blade screwdriver is outside circle 9, the configuration of a phillips-type blade screwdriver prevents use of either channel 4 or 6 as a guide since the tip of a phillips-type blade screwdriver is often times intentionally blunted, and as such is too wide to fit within either channel 4 or 6. Phillips-type blade screwdrivers are intentionally blunted so that the tip point does not abut the bottom center 8 which would prevent the blades of the phillips-type screwdriver from properly interacting with the screw 1. While smaller size phillips-type blade screwdrivers may have a tip size small enough to fit within channels 4 or 6, the blades of such phillips-type blade screwdrivers are then too small to properly engage the sides of channels 4 and 6 to provide maximum torque. Such would be the case if a #1 phillips-type blade screwdriver were used in conjunction with a screw having a #2 phillips-type screw head.

Additionally, in a phillips-type blade screwdriver that is blunted, the pair of opposing blades that fits within either channel 6 or depression 5 is typically as wide as either channel 6 or depression 5. Thus, when a phillips-type blade screwdriver is outside region 9 and unable to access depression 5, the pair of blades that is perpendicular to the pair of blades fitting in either channel 4 or 6, prevents a phillips-type blade from actually fitting within either channel.

Phillips-type blade screwdrivers that are not blunted do not allow a sufficient amount of tip to be inserted into channels 4 or 6 so as to use the channel as a guide towards the center. This lack of tip results from the wide blade arc necessary to allow the blades to properly engage the screw.

In contrast, the embodiment shown in FIG. 3 has a tip point 334 that is sufficiently small to fit within either channel 4 or channel 6. Proportional to the remainder of the screwdriver blade, the centering tip 330 is much smaller than the tips of other screwdrivers, especially a Phillips-type blade. Thus, when the screw head 2 is obscured from view, tip point 334 of the present invention can be used to "feel around" screw head 2 until tip point 334 enters region 9, or until tip point 334 enters one of the channels that can be used as a guide to direct the screwdriver blade 320 to region 9. In either case, region 335 is then used in conjunction with the rounded corner 7 and region 9 of the screw to properly center the screwdriver blade so that it can be rotated into the proper torquing position relative to the combo screw. The proper torquing position is reached when flat end 24 of the screwdriver 10 fits within channel 4 of the screw 1.

FIG. 3 advantageously incorporates the wedge-like foot 26 positioned adjacent flat end 24 to bite into the sides of channel 4. This substantially prevents the screwdriver blade 320 from slipping or jumping out of proper position during torquing. Flat-blade screwdrivers usually have converging flat sides, but do not have a foot 26 and thus have a tendency to pop out of position when being turned. Thus, not only does the invention provide a centering tip for assisting in channeling the screwdriver to the center so the flathead 24 can be rotated quickly into position, but foot 26 ensures the proper position is securely maintained during torquing.

Figure 4:
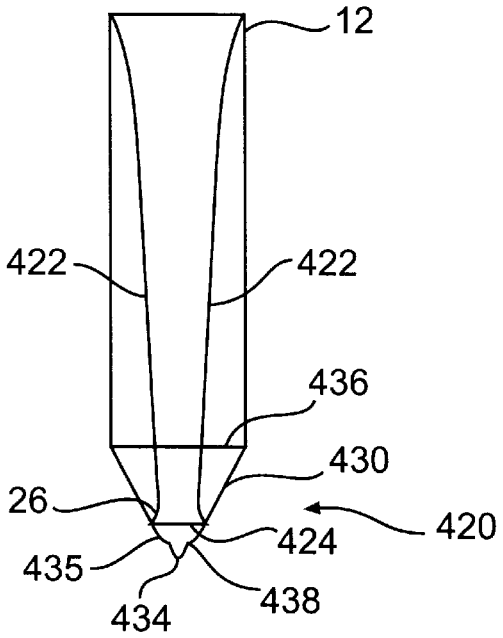
FIG. 4 is a side elevational view of a second embodiment of the invention.

Another embodiment of the invention is illustrated in FIG. 4. In this embodiment, the centering tip 430 is significantly larger than the embodiment depicted in FIG. 3. Furthermore, a portion of shaft 12 is extended to meet the base 436 of centering tip 430, thus slightly reducing the area of flat sides 422 as compared to sides 322. Centering tip 430 includes a nipple 434 at its lower most point for engaging slots 4 and 6 in the head 2 of the combo screw 1 shown in FIG. 1. It is the relative dimensions of flat end 424 and therefore the corresponding screw channels, as compared to nipple 434, that ensures that nipple 434 can be used to assist in centering as mentioned above.

In this embodiment, the interface between nipple 434 and region 435 forms a boundary 438. This embodiment allows nipple 434 to be used in centering, and further allows region 435 to cooperate with the rounded corners 7 of the screw head to assist in centering once nipple 434 is guided along one of the channels 4 or 6 into region 9 of the screw. Boundary 438 is formed as a result of the wider angle, as measured from the central longitudinal axis of the screwdriver, that region 435 forms as compared to that of nipple 434.

Figure 5:
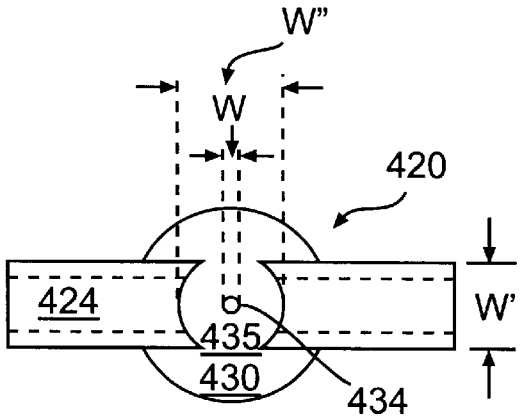
FIG. 5 is a bottom plan view of the embodiment shown in FIG. 4.

FIG. 5 illustrates a bottom view of the embodiment depicted in FIG. 4. The width W of nipple 434 is less than the width of either channels 4 or 6 of screw 1. In a typical combo screw the width of channel 4 is at least as great as the width of channel 6. The width W' in FIG. 5 corresponds to that of flat end 424 and width W' must be less than that of channel 4 for the screwdriver to function properly. Region 435 is shown as tapering from width W' to width W". Width W" is less than the diameter of region 9 of screw 1 so that bottom face 424 of screwdriver blade 420 is not prevented by region 435 (or width W") from fitting within channel 4 of screw 1.

Figure 6:
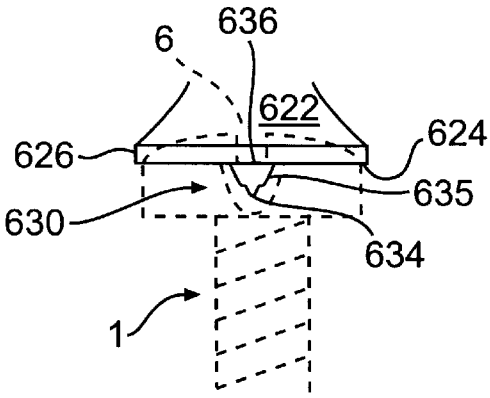
FIG. 6 is a front elevational view of a third embodiment fitted to a dashed-outline of the combo screw shown in FIGS. 1 and 2.

FIG. 6 illustrates a side view of another embodiment of the invention in which nipple 634 is slightly rounded as compared to the embodiment illustrated in FIGS. 4 and 5, however, region 635 is very similar to region 435 of FIG. 4. Furthermore, tip base 636 is flush against end surface 624 of the screwdriver blade. FIG. 6 also shows screw 1 in dashed lines in order to depict the cooperative fit between the screwdriver blade 20 and screw 1. The flat head portion which is comprised of the pair of surfaces 622, end surface 624 and foot 626 is positioned within channel 4 of screw 1. Centering tip 630 is located within depressed region 9. It should be noted that centering tip 630 is sized such that the depth that centering tip 630 extends within the depressed region 9 is less than the entire depth of this depression 9. Also, the width W of nipple 634 is illustrated as being less than the width of channel 6 as described above.

Figure 7:
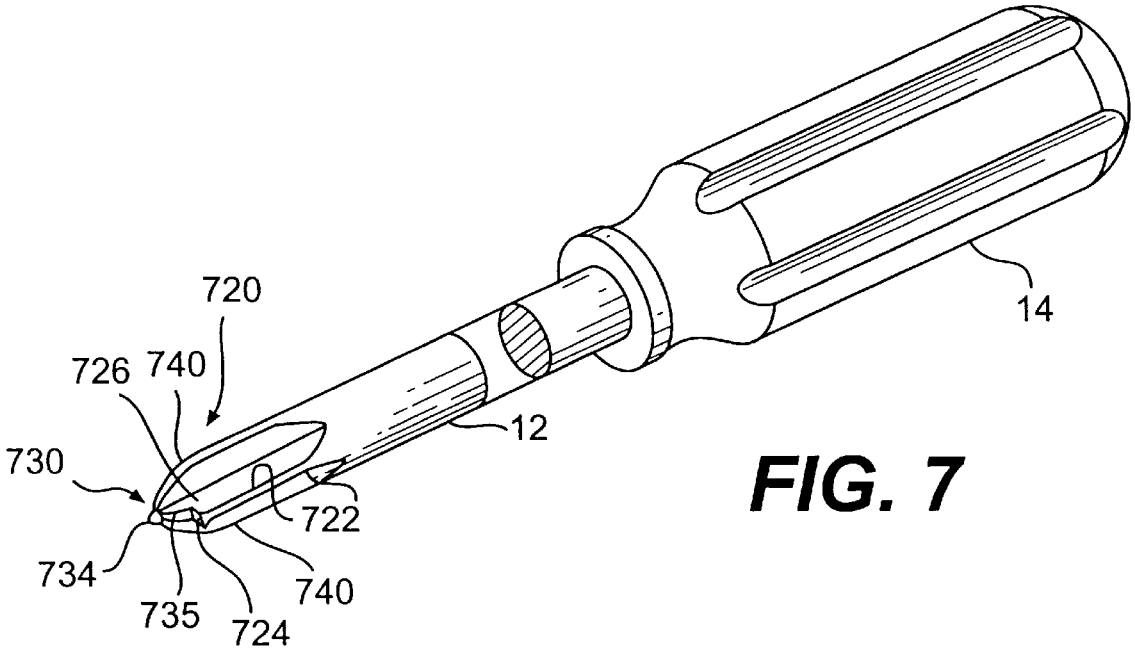
FIG. 7 is a perspective view of a fourth embodiment of the invention.
Figure 8:
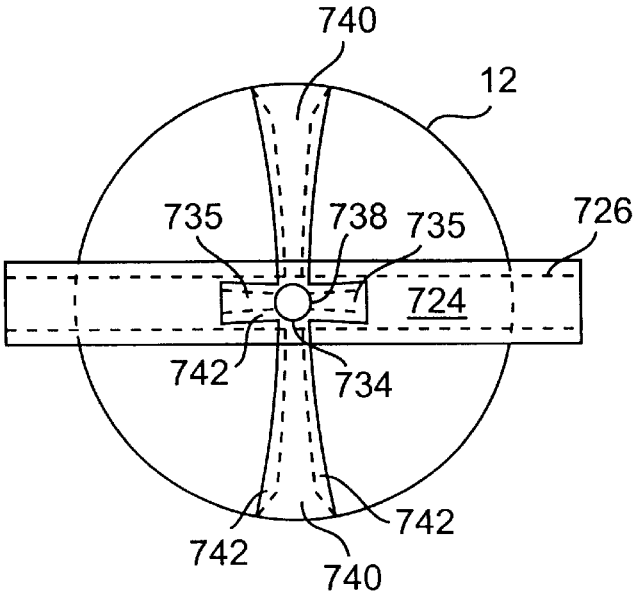
FIG. 8 is a bottom plan view of the embodiment of the invention shown in FIG. 7.

FIGS. 7 and 8 illustrate another embodiment of the invention in which blade 720 comprises a combination of a flat-blade having a foot and a phillips-type blade. Flat blade pairs 722 are shown having foot portions 726 and flat ends 724 at their distal ends. Located transverse to flat blade pairs 722 are phillips-type blade pairs 740. A portion of blade pairs 722 also extend distally of flat ends 724 to form blade portions 735. Advantageously, nipple 734 is positioned on the distal tip of blade portions 735 and blade pairs 740. Nipple 734 has a width that is no wider than either pair of blades 735 or 740. Nipple 734 is illustrated as having a rounded shape, but any shape that is narrower than channels 4 and 6 (intended to be used as guides) is satisfactory. This enables tip point 734 to be used as a means for locating the proper centering position of the screwdriver blade 720 relative to the screw head 2. The final position is achieved when end surface 724 is positioned in channel 4 and blade pairs 740 are positioned in channel 6 of the combo screw 1, shown in FIGS. 1 and 2.

Furthermore, the total length of region 735, boundary 738 and nipple 734 is less than the depth of region 9 of screw 1 so that nipple 734 does not abut bottom center 8 before flat end 724 interfaces with channel 4.

The embodiment of FIGS. 7 and 8 also show foot 726 adjacent to the flat end 724. The foot 726 is obscured from view in FIG. 8, but the dashed lines on flat end 724 outline foot 726. Both pairs of convex blades 735 and 740 also terminate in foot portions 742 that are depicted by dashed lines. Foot portions 742 are similar to the foot portion 726 that is adjacent flat end 724 because foot portions 742 also have a wedge-like shape that is adjacent to the bottom of each blade 735 and 740. The wedge shape of foot portions 742 bite into the mating portion of combo screw 1 (depression 5 and channel 6 respectively) to further reduce the likelihood of the screwdriver from jumping out during torquing, similar to the functioning of foot 726 described in conjunction with the previous embodiments.

Although the present invention has been described to specific exemplary embodiments thereof, it will be understood by those skilled in the art that variations and modifications can be effected in these exemplary embodiments without departing from the scope and spirit of the invention.

I claim:

1. A drive tool for driving a threaded fastener having a combination head with a flat slot for accommodating a flat-blade screwdriver end and a Phillips slot for accommodating a Phillips-type screwdriver end, said drive tool comprising:

a. a shaft having a distal end and a central longitudinal axis;

b. said distal end comprising a flat-blade portion having a foot portion positioned thereon for biting into the inner sides of the flat slot of the combination head, said foot portion having a width greater than the distal end of said flat-blade portion and less that the width of the flat slot, said flat-blade portion and said foot portion positioned substantially perpendicular to said central longitudinal axis;

c. said distal end further comprising a Phillips-type end portion wherein two Phillips-type blades are distal extensions of said flat-blade portion and the remaining two Phillips-type blades are perpendicularly positioned thereto, said blades positioned perpendicular to said flat-blade portion having Phillips-type foot portions thereon for biting into the Phillips slots of the combination head, said Phillips-type foot portions comprising wedge-like protrusions positioned along the distal ends of said blades, said protrusions being of greater width than said distal ends of said blades and of lesser width than the Phillips slot in said combination head.

2. A drive tool as in claim 1, wherein said foot portion positioned on said flat-blade end portion has a pentagon-shaped cross section.

3. A drive tool as in claim 1, wherein said foot portion positioned on said flat-blade end portion has a wedge-shaped cross section.

4. A drive tool as in claim 1, further comprising Phillips-type foot portions comprising wedge-like protrusions positioned along the distal ends of said blades that are distal extensions of said flat-blade portion.

5. A drive tool as in claim 1, wherein a nipple is positioned on the distal end of the Phillips-type end portion along said central longitudinal axis of said shaft, said nipple being of lesser diameter than the width of the slots in the head of the fastener for guiding said distal end of said drive tool into a driving position within said slots, said nipple being of a length such that the most distal surface of said foot portion of said flat-blade portion contacts the bottom of the flat slot when said drive tool is positioned in the head of the fastener.

* * * * *